US011538414B2

(12) United States Patent
Hung et al.

(10) Patent No.: US 11,538,414 B2
(45) Date of Patent: Dec. 27, 2022

(54) DRIVING CIRCUIT OF DISPLAY PANEL

(71) Applicant: Sitronix Technology Corp., Hsinchu County (TW)

(72) Inventors: Chih-Te Hung, Hsinchu County (TW); I-Chen Lin, Hsinchu County (TW); Chun-Chi Yeh, Hsinchu County (TW); Chia-Hung Chien, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 16/824,669

(22) Filed: Mar. 19, 2020

(65) Prior Publication Data

US 2021/0074219 A1 Mar. 11, 2021

Related U.S. Application Data

(60) Provisional application No. 62/820,279, filed on Mar. 19, 2019.

(51) Int. Cl.

| | |
|---|---|
| ***G09G 3/3258*** | (2016.01) |
| ***G09G 3/3266*** | (2016.01) |
| ***G09G 3/3275*** | (2016.01) |

(52) U.S. Cl.

CPC ..... *G09G 3/3266* (2013.01); *G09G 3/3275* (2013.01); *G09G 2320/02* (2013.01); *G09G 2330/021* (2013.01)

(58) Field of Classification Search

None

See application file for complete search history.

(56) References Cited

U.S. PATENT DOCUMENTS

| | | | | |
|---|---|---|---|---|
| 2004/0104686 | A1 | 6/2004 | Shin | |
| 2004/0169626 | A1 | 9/2004 | Nakamura | |
| 2006/0001615 | A1 | 1/2006 | Kim | |
| 2014/0361960 | A1 | 12/2014 | Yamauchi | |
| 2016/0307495 | A1* | 10/2016 | Chang | G09G 3/344 |
| 2016/0358531 | A1* | 12/2016 | Nakakita | G09G 3/3266 |

(Continued)

FOREIGN PATENT DOCUMENTS

| | | | |
|---|---|---|---|
| CN | 1450516 | A | 10/2003 |
| CN | 1512471 | A | 7/2004 |
| CN | 1930601 | A | 3/2007 |

(Continued)

*Primary Examiner* — Krishna P Neupane
(74) *Attorney, Agent, or Firm* — Winston Hsu

(57) ABSTRACT

A driving circuit of a display panel comprises a scanning driving circuit, a data driving circuit, and a control circuit. The scanning driving circuit is coupled to a plurality of scanning lines of the display panel, and scans the scanning lines. The data driving circuit is coupled to a plurality of data lines of the display panel and provides at least one data signal corresponding to each scanning line to at least one data line of the data lines for driving at least one pixel of the display panel. The control circuit is coupled to the scanning driving circuit and the data driving circuit, controls the scanning driving circuit and the data driving circuit, and determines a scanning order of the scanning driving circuit to scan the scanning lines according to a driving number of the pixels to be driven by the data driving circuit corresponding to each scanning line.

7 Claims, 13 Drawing Sheets

(56) References Cited

U.S. PATENT DOCUMENTS

2017/0270866 A1* 9/2017 Asano ..... G09G 3/3266

FOREIGN PATENT DOCUMENTS

| | | | |
|---|---|---|---|
| CN | 101443835 | A | 5/2009 |
| CN | 102402033 | A | 4/2012 |
| CN | 103886835 | A | 6/2014 |
| CN | 104849888 | A | 8/2015 |
| CN | 106663405 | A | 5/2017 |
| CN | 108735164 | A | 11/2018 |
| JP | 2003-66907 | A | 3/2003 |
| TW | 529004 | | 4/2003 |
| TW | 594642 | | 6/2004 |
| TW | I552129 | B | 10/2016 |

* cited by examiner

Scanning Order Based on Numbers of Lit Pixels

| COM | Lit Pixels |
|---|---|
| COM 5 | 0 |
| COM 3 | 10 |
| COM 10 | 22 |
| COM 13 | 23 |
| COM 14 | 26 |
| COM 4 | 30 |
| COM 2 | 33 |
| COM 9 | 45 |
| COM 8 | 46 |
| COM 11 | 48 |
| COM 1 | 56 |
| COM 7 | 65 |
| COM 6 | 75 |
| COM 12 | 100 |
| COM 15 | 112 |
| COM 16 | 128 |

Small

Large

Scanning Order Based on Numbers of Lit Pixels

| COM | Lit Pixels |
|---|---|
| COM 10 | 128 |
| COM 1 | 112 |
| COM 2 | 100 |
| COM 14 | 75 |
| COM 8 | 65 |
| COM 15 | 56 |
| COM 9 | 48 |
| COM 7 | 46 |
| COM 3 | 45 |
| COM 12 | 33 |
| COM 13 | 30 |
| COM 6 | 26 |
| COM 4 | 23 |
| COM 16 | 22 |
| COM 5 | 10 |
| COM 11 | 0 |

Large

Small

Scanning Order Based on Numbers of Lit Pixels

| COM | Lit Pixels |
|---|---|
| COM 5 | 0 |
| COM 10 | 22 |
| COM 14 | 26 |
| COM 2 | 33 |
| COM 8 | 46 |
| COM 1 | 56 |
| COM 6 | 75 |
| COM 15 | 112 |
| COM 16 | 128 |
| COM 12 | 100 |
| COM 7 | 65 |
| COM 11 | 48 |
| COM 9 | 45 |
| COM 4 | 30 |
| COM 13 | 23 |
| COM 3 | 10 |

Small
Large
Large
Small

Scanning Order Based on Numbers of Lit Pixels

| COM | Lit Pixels |
|---|---|
| COM 16 | 128 |
| COM 12 | 100 |
| COM 7 | 65 |
| COM 11 | 48 |
| COM 9 | 45 |
| COM 4 | 30 |
| COM 13 | 23 |
| COM 3 | 10 |
| COM 5 | 0 |
| COM 10 | 22 |
| COM 14 | 26 |
| COM 2 | 33 |
| COM 8 | 46 |
| COM 1 | 56 |
| COM 6 | 75 |
| COM 15 | 112 |

Large
Small
Small
Large

Scanning Order Based on Numbers of Lit Pixels

| COM | Lit Pixels |
|---|---|
| COM 13 | 23 |
| COM 1 | 56 |
| COM 7 | 65 |
| COM 16 | 128 |
| COM 5 | 0 |
| COM 14 | 26 |
| COM 9 | 45 |
| COM 12 | 100 |
| COM 3 | 10 |
| COM 2 | 33 |
| COM 11 | 48 |
| COM 6 | 75 |
| COM 10 | 22 |
| COM 4 | 30 |
| COM 8 | 46 |
| COM 15 | 112 |

Small
Large
Small
Large
Small
Large
Small
Large

Scanning Order Based on Numbers of Lit Pixels

| COM | Lit Pixels |
|---|---|
| COM 13 | 23 |
| COM 1 | 56 |
| COM 7 | 65 |
| COM 16 | 128 |
| COM 12 | 100 |
| COM 9 | 45 |
| COM 14 | 26 |
| COM 5 | 0 |
| COM 3 | 10 |
| COM 2 | 33 |
| COM 11 | 48 |
| COM 6 | 75 |
| COM 15 | 112 |
| COM 8 | 46 |
| COM 4 | 30 |
| COM 10 | 22 |

Small
Large
Large
Small
Small
Large
Large
Small

DRIVING CIRCUIT OF DISPLAY PANEL

CROSS REFERENCE TO RELATED APPLICATION

This application claims priority of Provisional Application No. 62/820,279, filed on Mar. 19, 2019, included herein by reference in its entirety.

BACKGROUND OF THE INVENTION

1. Field of the Invention

The invention relates to a driving circuit of a display panel, and more particularly, to a driving circuit of a display panel that is capable of preventing abnormal display images and achieving a power saving effect.

2. Description of the Prior Art

In a passive organic light emitting diode display, before a scanning driving circuit finishes scanning one of a plurality of scanning lines of a display panel, a data driving circuit may discharge pixels (or display units) that have been driven on the scanning line that has been scanned. In order to prevent electric charges stored in the parasitic capacitance of pixels on the other scanning lines that are not scanned from discharging for power saving, the scanning driving circuit controls those scanning lines that are not scanned to be in a state of high impedance state (Hi-Z state). However, voltage levels of scanning lines in the high impedance state will be affected by the discharge of the driven pixels, resulting in the voltage levels coupling down, i.e. voltage level dropping. When the scanning driving circuit scans a next scanning line and the data driving circuit provides power to the pixels thereon, the voltage levels of scanning lines that are not scanned and in the high impedance state will be coupled up, i.e. the voltage level will rise.

This driving method may result the display image to be abnormal. Before the scanning of each scanning line is completed and after the data driving circuit discharges the driven pixels, it is impossible to determine by how much the voltage level of the other scanning lines that are not scanned and in the high impedance state will drop. This may cause pixels that should have been disabled (not lit) on the scanning lines that are not scanned to be enabled (lit) for display, which will cause abnormal display images. Specifically, if a large number of pixels are driven (lit) on the scanning line that has been scanned, when these driven pixels are discharged, the voltage levels of the scanning lines that are not scanned and in the high impedance state will drop significantly. During the scanning of a next column of the scanning lines, if the number of pixels driven by the data driving circuit is relatively small, the voltage levels of the scanning lines in the high impedance state may not be pulled up to a safe threshold voltage level, which will enable pixels that should be disabled, thereby resulting in the abnormal display image, that affects the display quality.

This problem is further exacerbated in current driving methods, wherein the scanning driving circuit sequentially scans multiple scanning lines of a display device, for example, multiple scanning lines are sequentially scanned from top to bottom, or from bottom to top, without considering the number of pixels driven by the data driving circuit when scanning each column of the scanning lines.

SUMMARY OF THE INVENTION

It is therefore a primary objective of the present invention to provide a driving circuit of a display panel, to solve the problems of the prior art.

A driving circuit of a display panel is disclosed. The driving circuit comprises a scanning driving circuit, a data driving circuit, and a control circuit. The scanning driving circuit is coupled to a plurality of scanning lines of the display panel, and scans the scanning lines. The data driving circuit is coupled to a plurality of data lines of the display panel, and provides at least one data signal corresponding to each scanning line to at least one data line of the data lines for driving at least one pixel of the display panel. The control circuit is coupled to the scanning driving circuit and the data driving circuit, controls the scanning driving circuit and the data driving circuit, and determines a scanning order of the scanning driving circuit to scan the scanning lines according to a driving number of the pixels to be driven by the data driving circuit corresponding to each scanning line.

A driving circuit of a display panel is disclosed. The driving circuit comprises a scanning driving circuit, a data driving circuit, and a control circuit. The scanning driving circuit is coupled to a plurality of scanning lines of the display panel, and provides a scan signal to a scanning line of the scanning lines for scanning the scanning line. The data driving circuit is coupled to a plurality of data lines of the display panel, and provides at least one data signal and a discharge level to at least one data line of the data lines. The control circuit is coupled to the scanning driving circuit and the data driving circuit, and controls the scanning driving circuit and the data driving circuit. The scanning driving circuit scans the scanning line. After the data driving circuit provides the at least one data signal to the at least one data line and before the data driving circuit provides the discharge level to the at least one data line to force the level of the at least one data line to become the discharge level, the scanning driving circuit controls the at least one scanning line that is not scanned to be in a first impedance state. While the level of the at least one data line becomes the discharge level, the scanning driving circuit controls the at least one scanning line that is not scanned to be in a second impedance state. The impedance of the second impedance state is lower than or equal to the impedance of the first impedance state. The impedance of the first impedance state is high impedance.

Another driving circuit of a display panel is disclosed. The driving circuit comprises a scanning driving circuit, a data driving circuit, and a control circuit. The scanning driving circuit is coupled to a plurality of scanning lines of the display panel, and provides a scan signal to a scanning line of the scanning lines for scanning the scanning line. The data driving circuit is coupled to a plurality of data lines of the display panel, and provides at least one data signal and a discharge level to at least one data line of the data lines. The control circuit is coupled to the scanning driving circuit and the data driving circuit, and controls the scanning driving circuit and the data driving circuit. The scanning driving circuit scans the scanning line. After the data driving circuit provides the at least one data signal to the at least one data line and before the data driving circuit provides the discharge level to the at least one data line to force the level of the at least one data line to become the discharge level, the scanning driving circuit controls the at least one scanning line that is not scanned to be in a high impedance state. While the scanning driving circuit scans next scanning line and the data driving circuit provides the at least one data signal to the at least one data line of the data lines, the scanning driving circuit controls the voltage level of the at least one scanning line that is not scanned to become a disable level.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular components. Manufacturers may refer to a component by different names as one skilled in the art may appreciate. Therefore, in the following description and claims, components shall be distinguished according to function instead of name. In the whole specifications and subsequent claims, the word "comprising" and "include" are open language and should be explained as "comprising but not limited to". Besides, the word "couple" includes any direct and indirect electrical connection. Thereby, if the description is that a first device is coupled to a second device, it means that the first device is connected to the second device directly, or the first device is connected to the second device via other device or connecting means indirectly.

Figure 1:
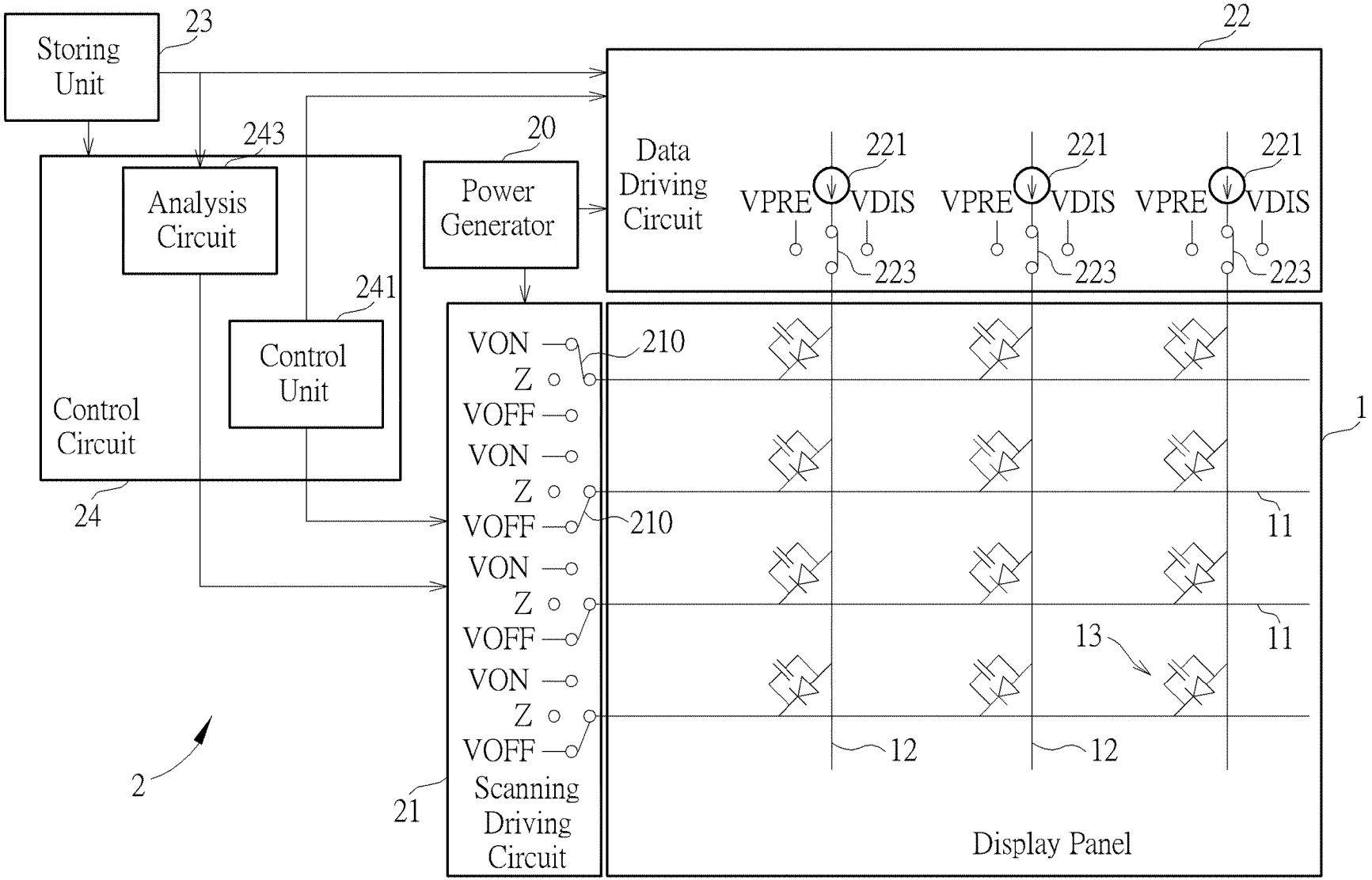
FIG. 1 is a schematic circuit block diagram of a driving circuit according to a first embodiment of the present invention.

Refer to FIG. 1, which is a schematic circuit block diagram of a driving circuit 2 according to a first embodiment of the present invention. The driving circuit 2 is used for driving a display panel 1. The display panel 1 comprises a plurality of scanning lines 11, a plurality of data lines 12 and a plurality of pixels 13. The scanning lines 11 are arranged horizontally and spaced apart from each other. The data lines 12 are arranged longitudinally and spaced apart from each other, and interlaced with the scanning lines 11. Each pixel 13 is disposed at an intersection of the corresponding scanning line 11 and data line 12 and is coupled to the corresponding scanning line 11 and data line 12. Each pixel 13 comprises an organic light emitting diode (OLED), and has the parasitic capacitance such as a coupling capacitance. In one embodiment of the present invention, the anode of the organic light emitting diode is coupled to the data line 12, and the cathode of the organic light emitting diode is coupled to the scanning line 11. The coupling capacitance is located between the scanning line 11 and the data line 12. In other embodiments, the pixel 13 may be another type of display unit, and is not limited thereto.

The driving circuit 2 comprises a power generator 20, a scanning driving circuit 21, a data driving circuit 22, a storing unit 23, and a control circuit 24. The power generator 20 is coupled to the scanning driving circuit 21 and the data driving circuit 22, and provides power (e.g. electrical voltage or current) to the scanning driving circuit 21 and the data driving circuit 22. The scanning driving circuit 21 is coupled to the scanning lines 11, and is configured to provide a scanning signal to the corresponding scanning lines 11 for scanning the scanning lines 11. In this embodiment, the scanning signal is a disable voltage VOFF or an enable level VON. The disable voltage VOFF is a high voltage relative to the enable level VON, and the enable level VON may be a ground level. When the scanning signal is the enable level VON, the scanning line 11 is scanned, and if the scanning signal is the disable voltage VOFF, the scanning line 11 is not scanned.

Figure 6:
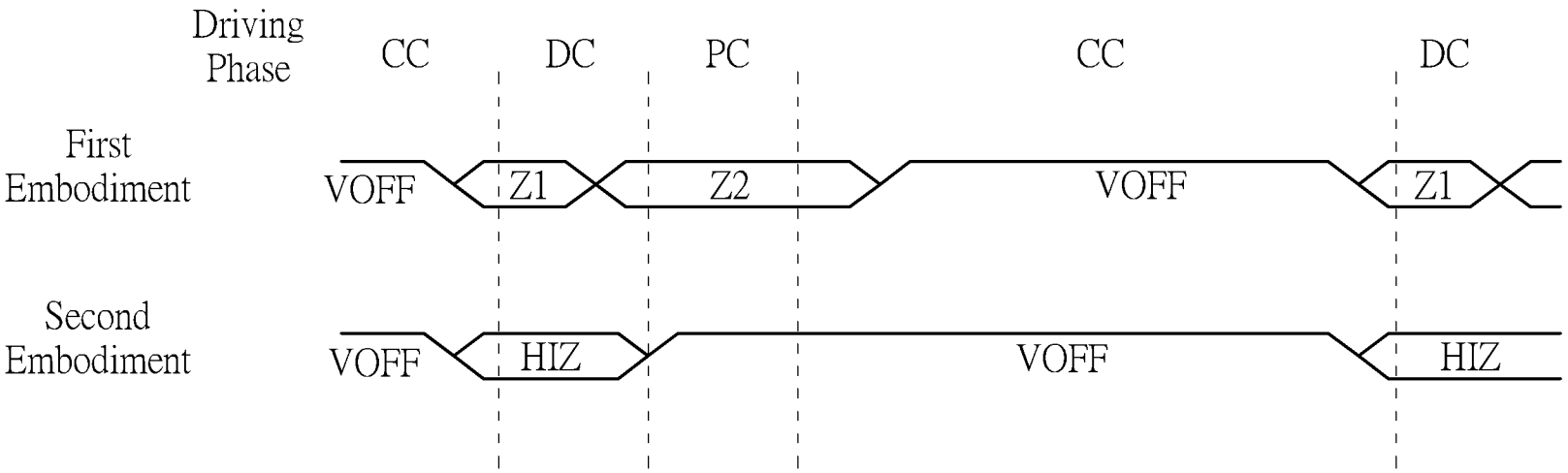
FIG. 6 is a schematic diagram of changes in states of the scanning lines that are not scanned according to the first and second embodiments of the present invention.

The scanning driving circuit 21 further has multiple impedance terminals Z, wherein the multiple impedance terminals Z respectively correspond to the scanning lines 11. When the scanning line 11 is coupled to the impedance terminal Z, the scanning line 11 is in a different impedance state, and the impedance of the scanning line 11 is therefore changed. In this embodiment, as shown in FIG. 6, the impedance state of the impedance terminal Z comprises a first impedance state and a second impedance state. The first impedance state has a first impedance Z1 with a higher impedance value, and the second impedance state has a second impedance Z2 with a lower impedance value. The data driving circuit 22 comprises a plurality of switching circuits 210 corresponding to the scanning lines 11 to provide the disable voltage VOFF or the enable level VON to the corresponding scanning lines 11, or to let the scanning lines 11 be coupled to the impedance terminals Z.

Figure 3:
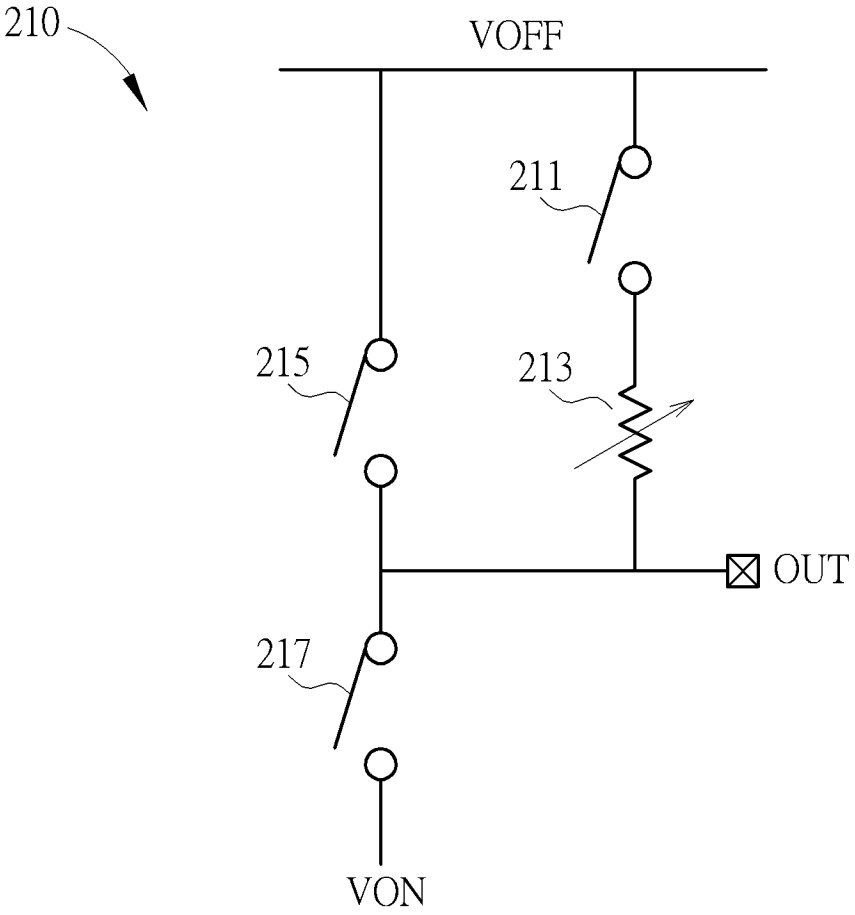
FIG. 3 is a circuit diagram of a switching circuit according to the first embodiment of the present invention.

Refer to FIG. 3, which is a circuit diagram of the switching circuit 210 according to the first embodiment of the present invention. As shown in FIG. 3, the switching circuit 210 comprises a first switch 211, a variable resistor 213, a second switch 215, and a third switch 217. The first switch 211 is coupled between the disable voltage VOFF and a first terminal of the variable resistor 213, and a second terminal of the variable resistor 213 is coupled to an output terminal OUT. The second switch 215 is coupled between the disable voltage VOFF and the output terminal OUT. The third switch 217 is coupled between the enable level VON and the output terminal OUT. In one embodiment of the present invention, the scanning driving circuit 21 controls the first switch 211, the second switch 215 and the third switch 217 according to a timing signal, or other circuits may control the switches 211, 215, and 217.

Following the above, when the first switch 211 and the second switch 215 are turned off and the third switch 217 is turned on, the level of the output terminal OUT becomes the enable level VON, which is equivalent to the scanning driving circuit 21 providing the enable level VON to the scanning line 11 by the switching circuit 210 for scanning the scanning line 11. When the first switch 211 and the third switch 217 are turned off and the second switch 215 is turned on, the disable voltage VOFF is transmitted to the output terminal OUT, which is equivalent to the scanning driving circuit 21 providing the disable voltage VOFF to the scanning line 11 by the switching circuit 210 for not scanning the scanning line 11, wherein the pixels 13 on the scanning line that is not scanned are turned off. When the first switch 211, the second switch 215, and the third switch 217 are all turned off, the output terminal OUT is open, meaning the output terminal OUT is in a high impedance state (Hi-Z state), and the impedance of the output terminal OUT is also a high impedance, being the first impedance Z1 in this embodiment. When the output terminal OUT is in the high impedance state, this is equivalent to the scanning driving circuit 21 coupling the scanning line 11 to the impedance terminal Z by the switching circuit 210 to force the scanning line 11 to be in the high impedance state. When the second switch 215 and the third switch 217 are turned off and the first switch 211 is turned on, the variable resistor 213 is connected to the disable voltage VOFF through the first switch 211, and the output terminal OUT will be in the second impedance state having the second impedance Z2. The second impedance Z2 is determined by the current resistance value of the variable resistor 213, which is equivalent to the scanning driving circuit 21 coupling the scanning line 11 to the impedance terminal Z by the switching circuit 210 to force the scanning line 11 to be in the second impedance state.

Refer to FIG. 1 again. The data driving circuit 22 is coupled to the data lines 12 and may provide multiple data signals to the data lines 12. The data driving circuit 22 has a plurality of current sources 221 to generate the data signals. In one embodiment of the present invention, each current source 221 may be a current mirror, which may mirror the current output from the power generator 20 to the data driving circuit 22. A plurality of switches 223 are respectively located between the current sources 221 and the data lines 12, and the current sources 221 provide currents to the pixels 13 through the switches 223 for driving the pixels 13 to light up. The currents of the current sources 221 are the data signals for driving the pixels 13. Therefore, the data driving circuit 22 controls the switches 223 according to the display data to provide currents to the pixels 13 to be driven. In one embodiment of the present invention, the display data may be stored in the storing unit 23 and the data driving circuit 22 is coupled to the storing unit 23 to receive the display data, or the display data may be directly transmitted to the data driving circuit 22 by a host of an electronic device.

The data driving circuit 22 may also provide a pre-charge voltage VPRE or a discharge level VDIS to the data lines 12 while the scanning driving circuit 21 scans each column of the scanning lines 11, so that the pre-charge voltage VPRE or the discharge level VDIS may be provided to part of the pixels 13. The data driving circuit 22 may enter a pre-charge phase PC before driving part of the pixels 13 to pre-charge the pixels 13 that will be driven, and then enter a constant current phase CC to provide current to the pixels 13 to be driven. After that, the data driving circuit 22 may enter a discharge phase DC to provide the discharge level VDIS to the pixels 13 that have been driven for discharging the pixels 13. In one embodiment of the present invention, the discharge level VDIS may be the level of the ground terminal. Similar to the above, the switches 223 are located between the pre-charge voltage VPRE and the data lines 12, and also located between the discharge level VDIS and the data lines 12, so the data driving circuit 22 may control the switches 223 according to the display data to provide the pre-charge voltage VPRE or the discharge level VDIS to part of the pixels 13. It should be noted that each current source 221 corresponds to one data line 12, so each current source 221 may drive the pixels 13 on the corresponding data line 12. In one embodiment of the present invention, one current source 221 may not only correspond to one data line 12, but may correspond to multiple data lines 12, in order to reduce the number of the current sources 221. In such a case, the switch 223 is still between the current source 221 and each data line 12.

The storing unit 23 may store the display data comprising information of the pixels 13 to be driven and the pixels 13 not to be driven by the data driving circuit 22 corresponding to each scanning line 11. Therefore, according to the display data, the driving number of the data driving circuit 22 to drive the pixels 13 for each scanning line 11 may be known.

Figure 2:
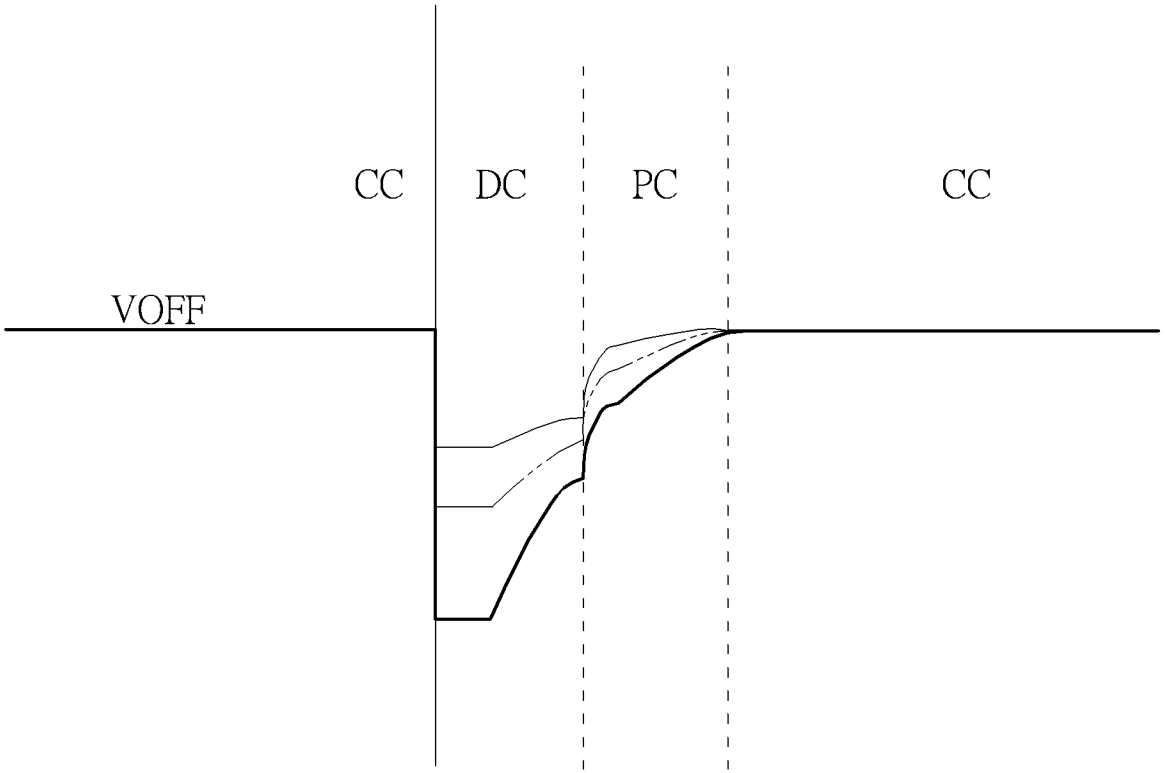
FIG. 2 is a schematic diagram of changes in a level of a scanning line that is not scanned according to the first embodiment of the present invention.

Refer to FIG. 2 and FIG. 6. The control circuit 24 is coupled to the scanning driving circuit 21, the data driving circuit 22 and the storing unit 23, and comprises a control unit 241 and a analysis circuit 243. The control unit 241 is coupled to the scanning driving circuit 21 and the data driving circuit 22 for providing a timing signal to the scanning driving circuit 21 and the data driving circuit 22. The scanning driving circuit 21 and the data driving circuit 22 operate according to the timing signal; for example, the scanning driving circuit 21 scans the scanning lines 11 according to the timing signal, and the data driving circuit 22 sequentially enters the pre-charge phase PC, the constant current phase CC and the discharge phase DC according to the timing signal.

The analysis circuit 243 may determine a first driving number of the pixels 13 to be driven by the data driving circuit 22 corresponding to the scanning line 11 that is scanned and a second driving number of the pixels 13 to be driven by the data driving circuit 22 corresponding to the next scanning line 11 that is scanned according to the display data. The analysis circuit 243 determines the impedance value of the second impedance Z2 according to the difference between the first driving number and the second driving number. The analysis circuit 243 generates an adjusting signal to the scanning driving circuit 21 to adjust the resistance value of the variable resistor 213. When the first driving number is greater than the second driving number, the impedance value of the second impedance Z2 is smaller than the impedance value of the first impedance Z1. Furthermore, when the first driving number is greater than the second driving number and the difference is larger, the impedance value of the second impedance Z2 is much smaller than that of the first impedance Z1. In other words, when the first driving number is greater than the second driving number and the difference is larger, this indicates that the voltage level of the scanning line 11 that is not scanned and in the high impedance state will be pulled down to a relatively low voltage level during the discharge phase DC. When the difference between the first driving number and the second driving number is large, the impedance value of the second impedance Z2 to be provided will be relatively small, so that the voltage level of the scanning line 11 that is not scanned may be stabilized to the disable voltage VOFF as soon as possible during the following phases.

Specifically, the control unit 241 of the control circuit 24 controls the scanning driving circuit 21 to scan the scanning lines 11, and controls the data driving circuit 22 to provide the data signals to the corresponding data lines 12 in the constant current phase CC to drive the corresponding pixels 13. Then, before the data driving circuit 22 provides the discharge level VDIS to the corresponding data lines 12 and the level of the corresponding data lines 12 is the discharge level VDIS (before entering the discharge phase DC), the scanning driving circuit 21 controls the scanning lines 11 that are not scanned to be in the first impedance state. The scanning lines 11 that are not scanned are coupled to the impedance terminal Z, and are driven to be in the high impedance state, so that the charges stored in the parasitic capacitances of the pixels 13 on the scanning lines 11 that are not scanned will not be discharged during the discharge phase DC to save power. In addition, during the period, the level of the corresponding data line 12 becomes the discharge level VDIS, the scanning driving circuit 21 further controls the scanning lines 11 that are not scanned to be in the second impedance state. The scanning driving circuit 21 controls the switching circuit 210 to force the impedance value of the scanning lines 11 that are not scanned to be the second impedance Z2. This allows the voltage level of the scanning lines 11 that are not scanned to be pulled up, and keeps the scanning lines 11 that are not scanned in the second impedance state until the scanning driving circuit 21 scans the next scanning line 11 and the data driving circuit 22 provides the pre-charge voltage VPRE to the corresponding data lines 12 (the pre-charge phase PC). This may continue to the constant current phase CC, so that the voltage level of the scanning lines 11 that are not scanned may be stabilized near to the disable level of the disable voltage VOFF. In addition, in order to prevent the time of the discharge phase from being too short and the voltage level of scanning lines 11 that are not scanned not being pulled up to a predetermined level, a start time of the scanning lines 11 that are not scanned to be in the second impedance state may be set according to the time length of the discharge phase. In particular, in this embodiment, the impedance value of the second impedance Z2 is smaller than the impedance value of the first impedance Z1; and when the first driving number is equal to the second driving number or the difference between the first driving number and the second driving number is not large, the impedance value of the second impedance Z2 may be equal to the impedance value of the first impedance Z1.

Furthermore, in order to ensure that the voltage level of the scanning lines 11 that are not scanned is stable to the disable level of the disable voltage VOFF, the scanning driving circuit 21 provides the disable voltage VOFF to the scanning lines 11 that are not scanned while the scanning driving circuit 21 scans the next scanning line 11 and enters the constant current phase CC. In this way, while the scanning driving circuit 21 scans the next scanning line 11 and the data driving circuit 22 provides the data signals to the corresponding data lines 12, the scan driving circuit 21 may control the voltage level of the scanning lines 11 that are not scanned to be the disable level. The disable level is different from the voltage level of the scanning lines 11 that are not scanned in the second impedance state. Furthermore, the disable level is not lower than the value of the voltage provided by the data driving circuit 22 to the pixel 13 minus a threshold voltage at which the pixel 13 is turned on. As seen from the above, this embodiment raises the voltage level of the scanning lines 11 that are not scanned by keeping the scanning lines 11 that are not scanned in the second impedance state, which may ensure that the voltage level of the scanning lines 11 that are not scanned may be maintained near the disable level. Furthermore, the pixels 13 on the scanning lines 11 that are not scanned may be turned off, so that the display image of the display panel 1 may be normal. By keeping the scanning lines 11 that are not scanned in the first impedance state with high impedance, the charges stored in the parasitic capacitances of the pixels 13 may be locked to achieve the power saving effect.

Figure 4:
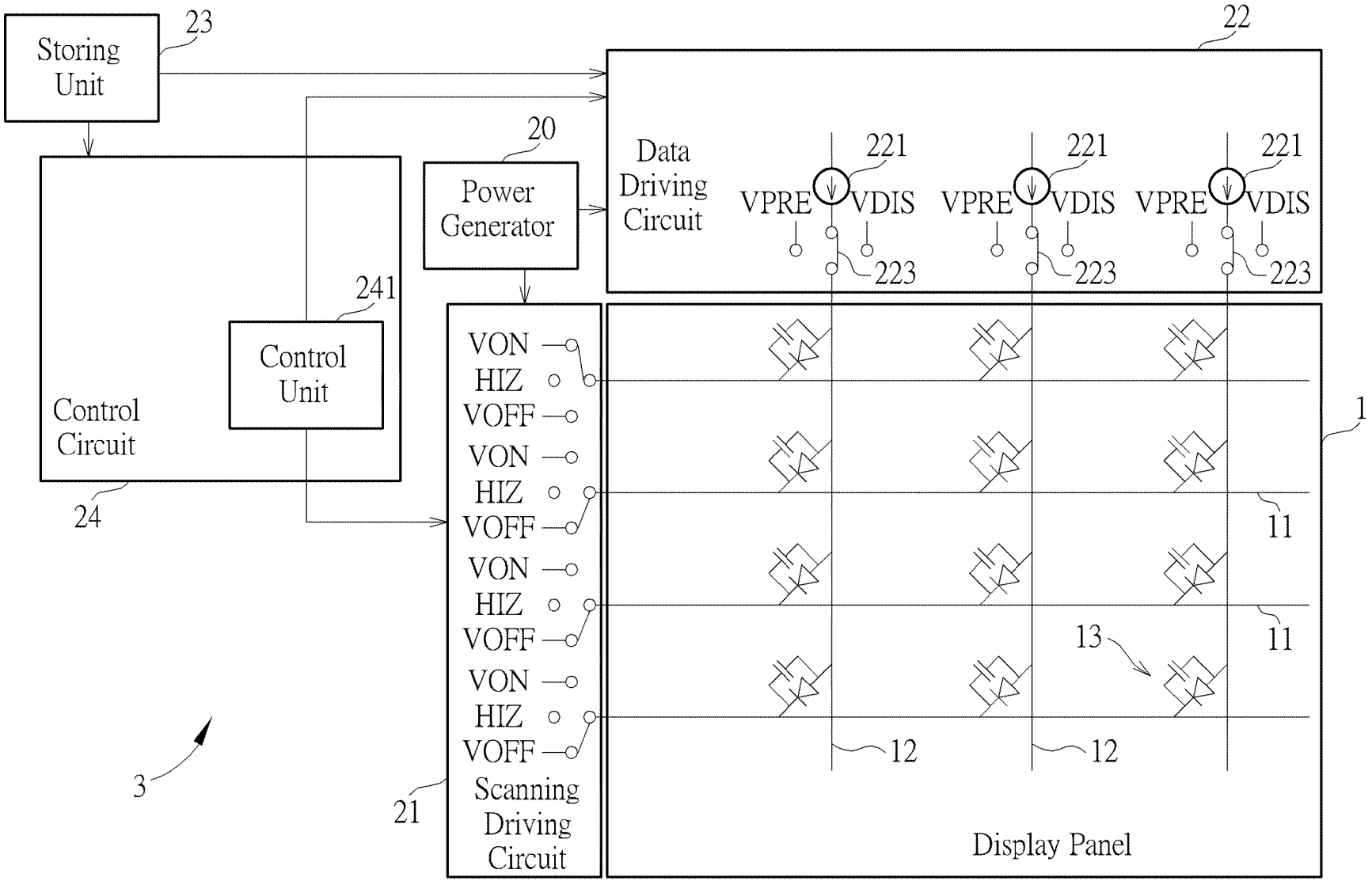
FIG. 4 is a schematic circuit block diagram of a driving circuit according to a second embodiment of the present invention.
Figure 5:
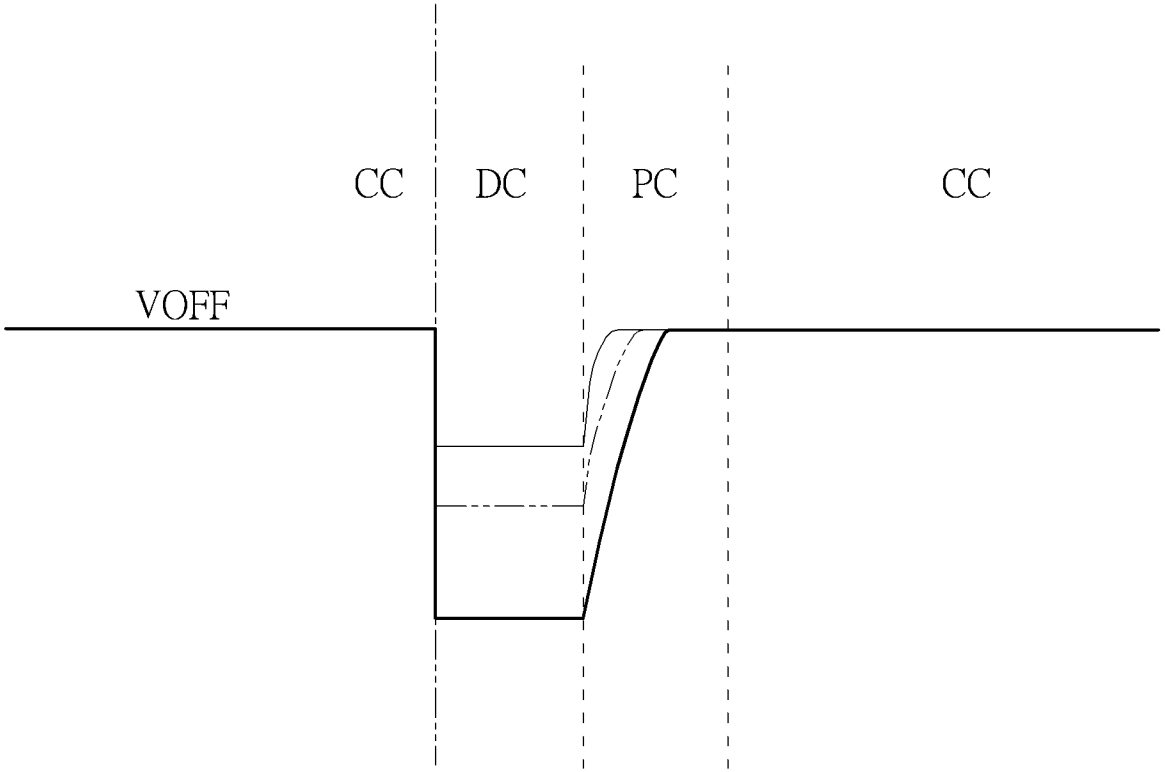
FIG. 5 is a schematic diagram of changes in a level of a scanning line that is not scanned according to the second embodiment of the present invention.

The above embodiments are used to illustrate the concept of the present invention; those skilled in the art may make modifications and changes accordingly, and are not limited to the above described embodiments. Refer to FIG. 4, which is a schematic circuit block diagram of a driving circuit 3 according to a second embodiment of the present invention. The second embodiment of the present invention is similar to the first embodiment described above, and therefore the same elements are denoted by the same symbols. In the second embodiment, the control circuit 24 may not have an analysis circuit. Refer to FIG. 5 and FIG. 6. Before the discharge phase DC, the scanning driving circuit 21 may directly control scanning lines 11 that are not scanned to be in a high impedance state, so that charges of the parasitic capacitance of the pixels 13 on the scanning lines 11 that are not scanned will not be discharged. Furthermore, the scanning driving circuit 21 may provide the disable voltage VOFF to the scanning lines 11 that are not scanned during the discharge phase DC, so that the voltage level of the scanning lines 11 that are not scanned becomes the disable level. Furthermore, when the next scanning line 11 is scanned, the scanning driving circuit 21 may also provide the disable voltage VOFF to the scanning lines 11 that are not scanned during the pre-charge phase PC or the constant current phase CC, so that the voltage level of the scanning lines 11 that are not scanned becomes the disable level.

In the second embodiment, the control circuit 24 may also have the analysis circuit (not shown). The control circuit 24 may determine a start time that the scanning driving circuit 21 controls the voltage level of the scanning lines 11 that are not scanned to become the disable level according to the difference between the first drive number (present scanned) and the second drive number (next scan). The start time may be in the discharge phase DC or in the pre-charge phase PC (while the next scanning line 11 is scanned) for fine adjustment, or may be in the constant current phase CC (while the next scanning line 11 is scanned). It should be noted that, when the first driving number is greater than the second driving number and the difference between the both is larger, the earlier the start time for the scanning driving circuit 21 to control the voltage level of the scanning lines 11 that are not scanned to become the disable level. That is, the sooner the voltage level of the scanning lines 11 that are not scanned is increased, the more the display quality may be optimized. In addition, in this embodiment, the impedance HIZ of the scanning lines 11 that are not scanned in the high impedance state is adjustable, and may be determined according to the difference between the first driving number and the second driving number. For example, as shown in FIG. 3, the variable resistor 213 adjusts the impedance HIZ in the high impedance state. The first and second embodiments described above not only may be applied when the first driving number is greater than the second driving number, but also when the first driving number is less than the second driving number. The display quality may also be maintained while saving power.

Figure 7:
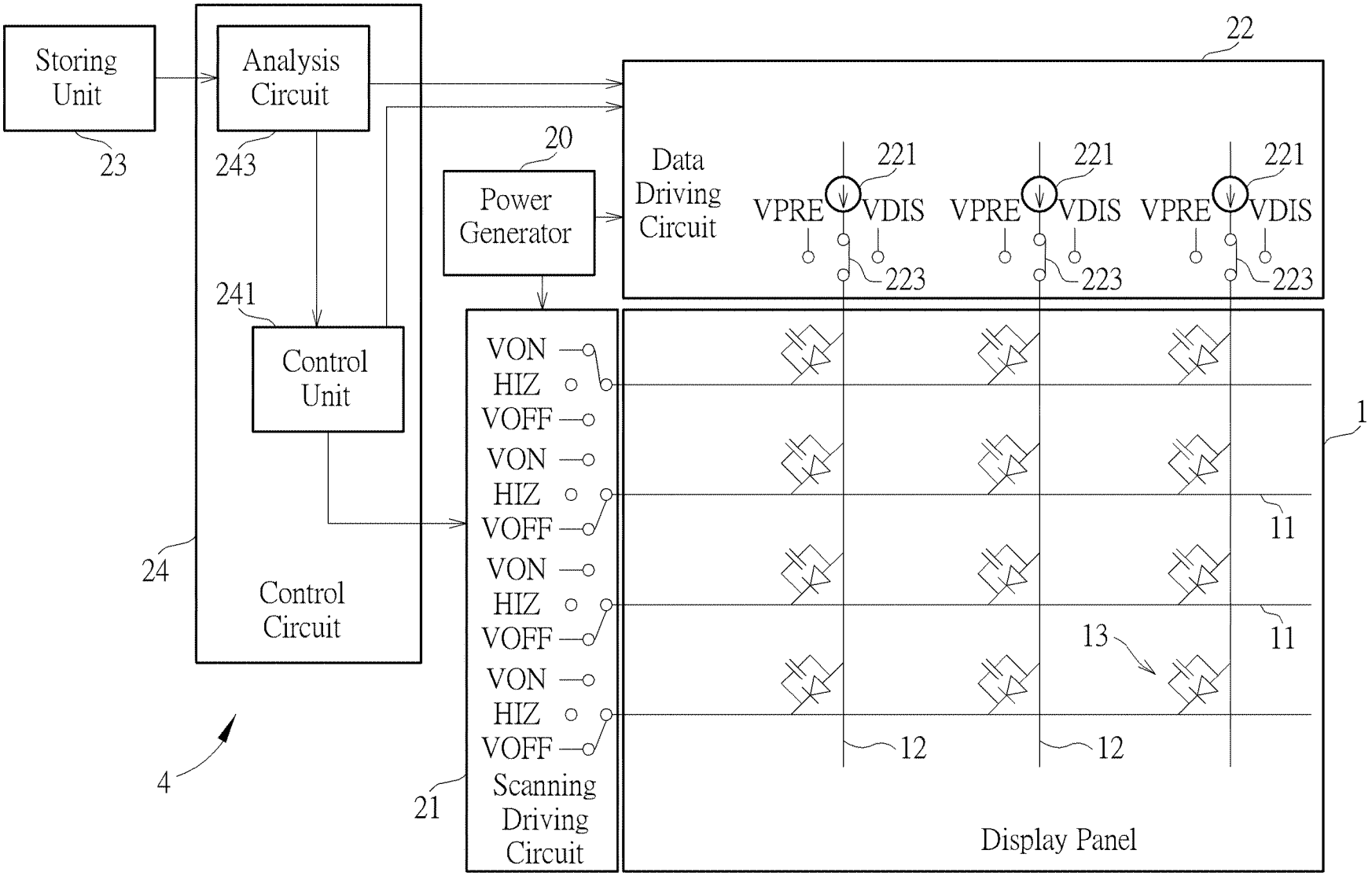
FIG. 7 is a schematic circuit block diagram of a driving circuit according to a third embodiment of the present invention.

Refer to FIG. 7, which is a schematic circuit block diagram of a driving circuit 4 according to a third embodiment of the present invention. The third embodiment of the present invention is similar to the first embodiment, so the same elements are denoted by the same symbols. In the third embodiment, the control circuit 24 further has an analysis circuit 243. The analysis circuit 243 of the control circuit 24 may obtain a driving number of the pixels 13 to be driven (lit) by the data driving circuit 22 corresponding to each scanning line 11 according to the display data, and determine the scanning order of the scanning driving circuit 21 to scan the scanning lines 11. In detail, the analysis circuit 243 may determine the driving number of each scanning line 11 according to the display data, and determine the scanning order according to the smaller difference between the driving numbers. In a preferred embodiment of the present invention, the scanning order is based on the smallest difference, meaning the display image is less likely to be abnormal, and a better power saving effect may also be achieved.

Figure 8:
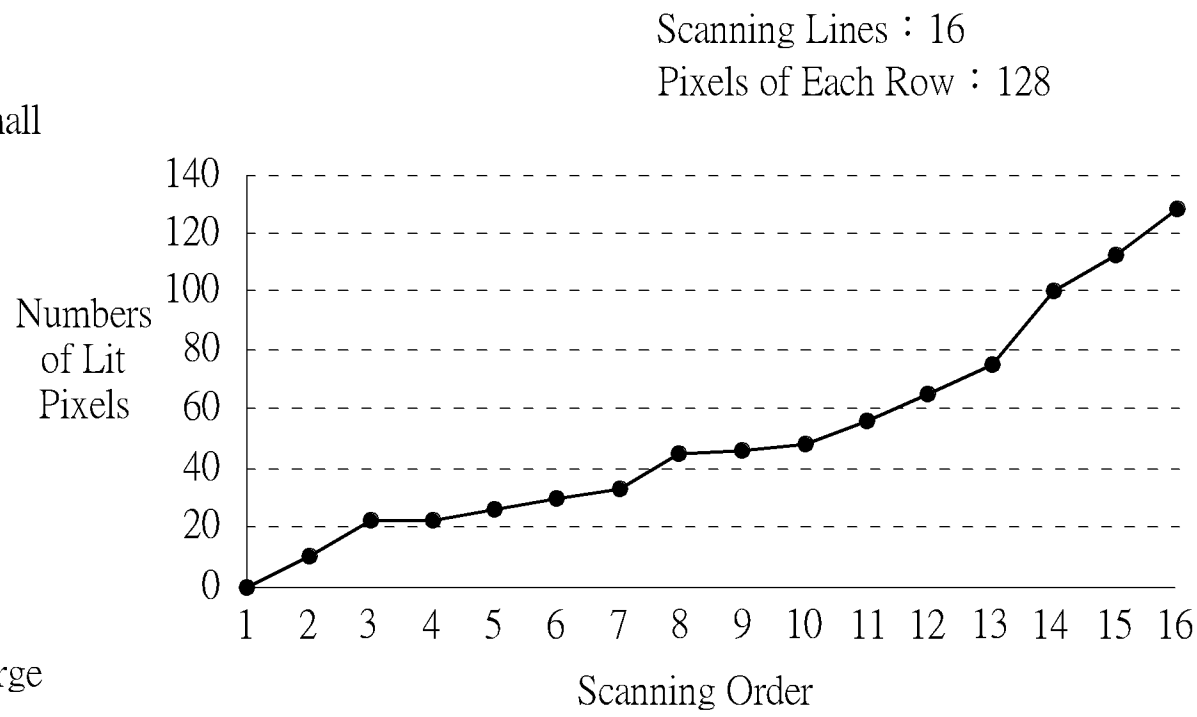
FIG. 8 is a schematic diagram of a scanning sequence according to the third embodiment of the present invention.
Figure 9:
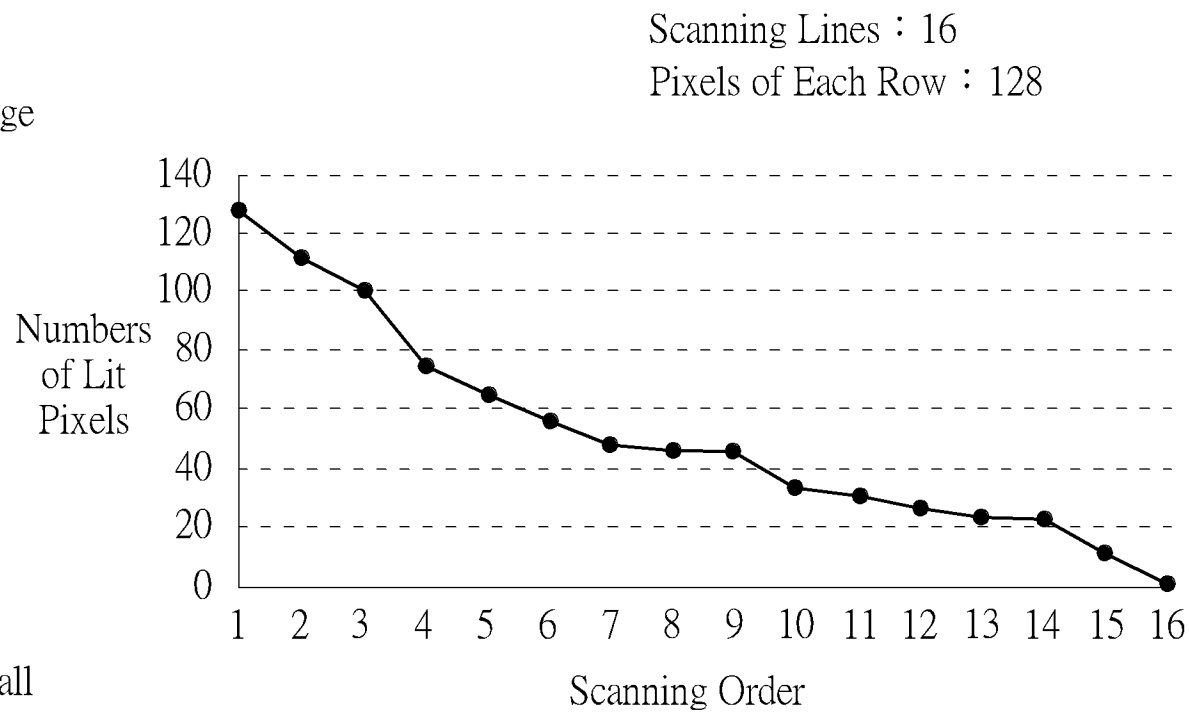
FIG. 9 is a schematic diagram of a scanning sequence according to the third embodiment of the present invention.
Figure 10:
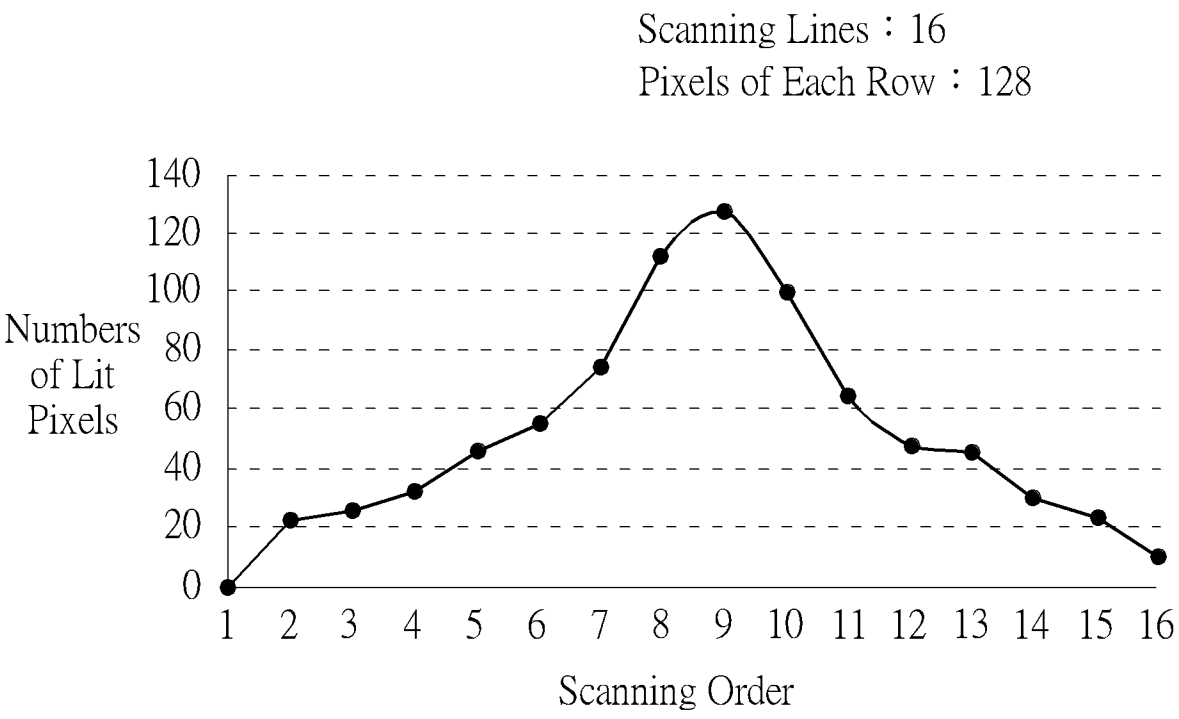
FIG. 10 is a schematic diagram of a scanning sequence according to the third embodiment of the present invention.
Figure 11:
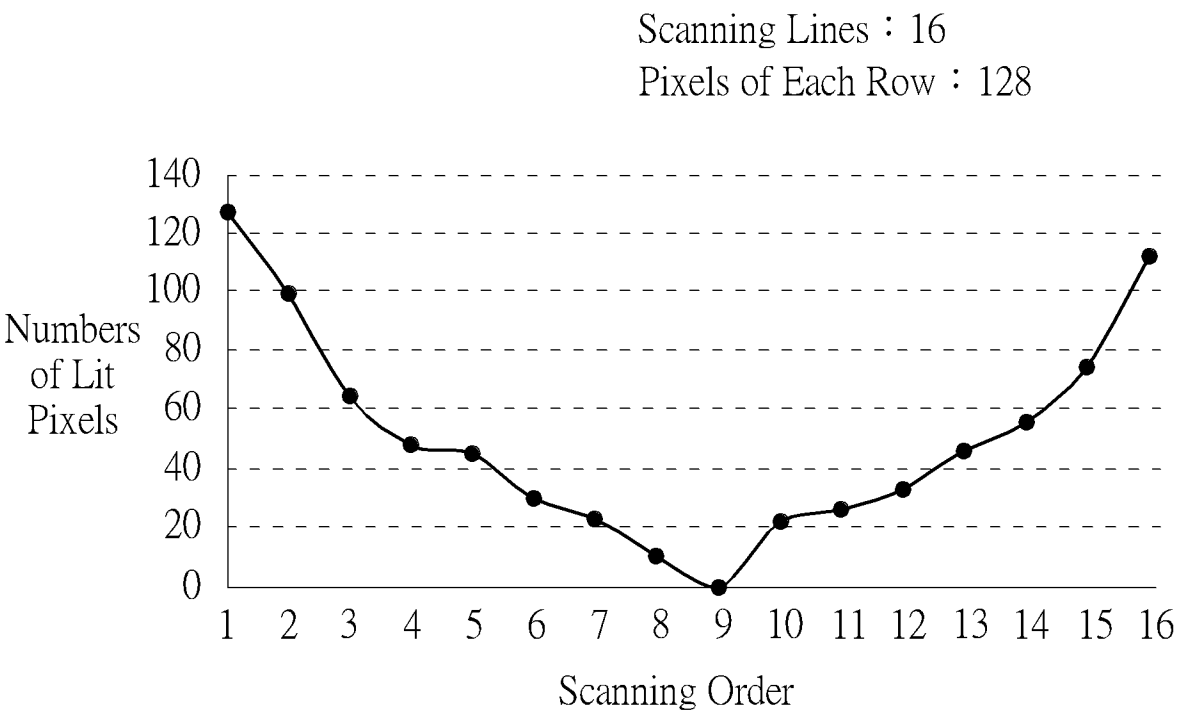
FIG. 11 is a schematic diagram of a scanning sequence according to the third embodiment of the present invention.

Specifically, as shown in FIG. 8, assuming that the scanning lines 11 have 16 columns in total, and that there are 128 pixels 13 on each column of the scanning line 11, the scanning order may be prioritized by the scanning line 11 corresponding to the driving number having a smaller value. The scanning order is from the scanning line 11 having a smaller driving number to the scanning line 11 having a larger driving number. On the contrary, as shown in FIG. 9, the scanning order may also be prioritized by the scanning line 11 corresponding to the driving number having a larger value. In this case, the scanning order is from the scanning line 11 having a larger driving number to the scanning line 11 having a smaller driving number. Furthermore, as shown in FIG. 10, the scanning order may also be from the scanning line 11 having a smaller driving number to the scanning line 11 having a larger driving number, and then from the scanning line 11 having a larger driving number to the scanning line 11 having a smaller driving number. Alternatively, as shown in FIG. 11, the scanning order may be from the scanning line 11 having a larger driving number to the scanning line 11 having a smaller driving number, and then from the scanning line 11 having a smaller driving number to the scanning line 11 having a larger driving number. In this way, the difference between the driving numbers before and after may be made smaller, ensuring that the display image is less prone to abnormalities.

Figure 12:
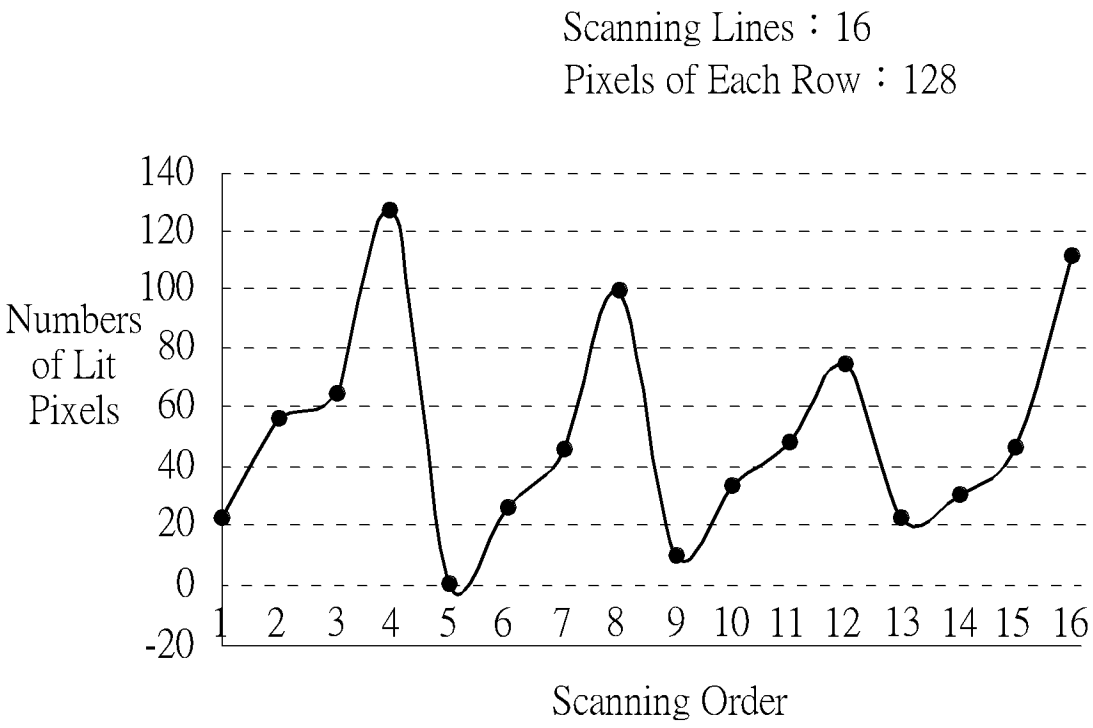
FIG. 12 is a schematic diagram of a scanning sequence according to the third embodiment of the present invention.
Figure 13:
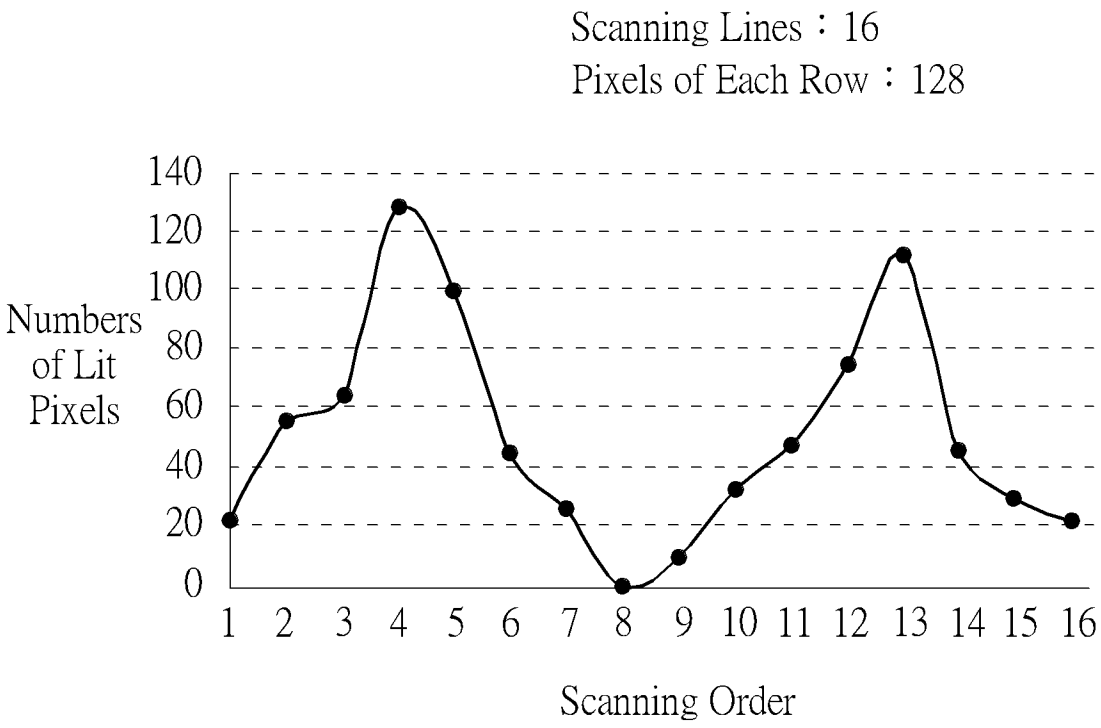
FIG. 13 is a schematic diagram of a scanning sequence according to the third embodiment of the present invention.

As shown in FIG. 12, the control circuit 24 may group the scanning lines according to the driving numbers. In this embodiment, four scanning lines 11 are used as a group, and the scanning order of each group of the scanning lines 11 is preferentially from the scanning line 11 corresponding to the driving number having a smaller value. Alternatively, the scanning order of each group of the scanning lines 11 is preferentially from the scanning line 11 corresponding to the driving number having a larger value. As shown in FIG. 13, between groups adjacent to each other in the scanning order, scanning order may be performed from greater to smaller driving number, and then from smaller to greater driving number, and is not limited thereto.

In summary, the present invention may ensure that the voltage level of the scanning lines that are not scanned may be stabilized to the disable level by increasing the voltage level of those scanning lines that are not scanned. The display image of the display panel may not have abnormalities while power saving is achieved. In addition, the scanning order of the scanning lines is determined according to the difference between driving numbers, which further makes the display image less prone to abnormalities.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving circuit of a display panel comprising:

a scanning driving circuit, coupled to a plurality of scanning lines of the display panel, and scanning the scanning lines;

a data driving circuit, coupled to a plurality of data lines of the display panel, and providing at least one data signal corresponding to each scanning line to at least one data line of the data lines for driving at least one pixel of the display panel; and a control circuit, coupled to the scanning driving circuit and the data driving circuit, controlling the scanning driving circuit and the data driving circuit, grouping the scanning lines and determining a scanning order of each group of the scanning lines of the scanning driving circuit to scan the scanning lines according to a driving number of the pixels to be driven by the data driving circuit corresponding to each scanning line.

2. The driving circuit of claim 1, wherein the control circuit determines the driving numbers of the pixels to be driven by the data driving circuit corresponding to each scanning line according to a display data.

3. The driving circuit of claim 1, wherein the control circuit determines the scanning order according to a minimum difference between the driving numbers of the data driving circuit corresponding to the scanning lines.

4. The driving circuit of claim 1, wherein the control circuit groups the scanning lines according to the driving numbers of the data driving circuit corresponding to the scanning lines, and the scanning order of the group of the scanning lines begins from a scanning line of the scanning lines corresponding to the driving number having a smaller value.

5. The driving circuit of claim 1, wherein the control circuit groups the scanning lines according to the driving numbers of the data driving circuit corresponding to the scanning lines, and the scanning order of the group of the scanning lines begins from a scanning line of the scanning lines corresponding to the driving number having a larger value.

6. A driving circuit of a display panel comprising:

a scanning driving circuit, coupled to a plurality of scanning lines of the display panel, and scanning the scanning lines;

a data driving circuit, coupled to a plurality of data lines of the display panel, and providing at least one data signal corresponding to each scanning line to at least one data line of the data lines for driving at least one pixel of the display panel; and a control circuit, coupled to the scanning driving circuit and the data driving circuit, controlling the scanning driving circuit and the data driving circuit, and determining a scanning order of the scanning driving circuit to scan the scanning lines according to a driving number of the pixels to be driven by the data driving circuit corresponding to each scanning line, wherein the scanning order begins from a scanning line of the scanning lines corresponding to the driving number having a smaller value to a scanning line of the scanning lines corresponding to the driving number having a larger value, then from a scanning line of the scanning lines corresponding to the driving number having a larger value to a scanning line of the scanning lines corresponding to the driving number having a smaller value.

7. A driving circuit of a display panel comprising:

a scanning driving circuit, coupled to a plurality of scanning lines of the display panel, and scanning the scanning lines;

a data driving circuit, coupled to a plurality of data lines of the display panel, and providing at least one data signal corresponding to each scanning line to at least one data line of the data lines for driving at least one pixel of the display panel; and a control circuit, coupled to the scanning driving circuit and the data driving circuit, controlling the scanning driving circuit and the data driving circuit, and determining a scanning order of the scanning driving circuit to scan the scanning lines according to a driving number of the pixels to be driven by the data driving circuit corresponding to each scanning line;

wherein the scanning order begins from a scanning line of the scanning lines corresponding to the driving number having a larger value to a scanning line of the scanning lines corresponding to the driving number having a smaller value, then from a scanning line of the scanning lines corresponding to the driving number having a smaller value to a scanning line of the scanning lines corresponding to the driving number having a larger value.

* * * * *